US008033967B2

(12) United States Patent
Canali

(10) Patent No.: US 8,033,967 B2
(45) Date of Patent: Oct. 11, 2011

(54) GYM MACHINE

(76) Inventor: Vincenzo Canali, Tizzano Val Parma (IT)

( * ) Notice: Subject to any disclaimer, the term of this patent is extended or adjusted under 35 U.S.C. 154(b) by 0 days.

(21) Appl. No.: 12/452,210

(22) PCT Filed: Jul. 1, 2008

(86) PCT No.: PCT/IB2008/001722

§ 371 (c)(1),
(2), (4) Date: Dec. 22, 2009

(87) PCT Pub. No.: WO2009/004458

PCT Pub. Date: Jan. 8, 2009

(65) Prior Publication Data

US 2010/0144500 A1 Jun. 10, 2010

(30) Foreign Application Priority Data

Jul. 3, 2007 (IT) ..... MI2007A1317

(51) Int. Cl.
*A63B 21/00* (2006.01)
*A63B 69/06* (2006.01)

(52) U.S. Cl. ..... 482/137; 482/72

(58) Field of Classification Search ..... 482/72, 482/95, 96, 99, 133–138
See application file for complete search history.

(56) References Cited

U.S. PATENT DOCUMENTS

| | | | | |
|---|---|---|---|---|
| 5,447,480 | A * | 9/1995 | Fulks | 482/99 |
| 5,549,530 | A * | 8/1996 | Fulks | 482/100 |
| 5,702,328 | A | 12/1997 | Mansvelt | |
| 5,733,229 | A * | 3/1998 | Dalebout et al. | 482/96 |
| 5,967,954 | A * | 10/1999 | Habing | 482/137 |
| 6,066,073 | A | 5/2000 | Stearns et al. | |
| 6,251,052 | B1 * | 6/2001 | Simonson | 482/100 |
| 6,264,588 | B1 * | 7/2001 | Ellis | 482/137 |
| 7,614,985 | B2 * | 11/2009 | Mosimann et al. | 482/137 |
| 2003/0232703 | A1 * | 12/2003 | Webber | 482/95 |
| 2005/0032611 | A1 * | 2/2005 | Webber et al. | 482/72 |
| 2006/0252613 | A1 * | 11/2006 | Barnes et al. | 482/95 |

* cited by examiner

*Primary Examiner* — Allana Lewin
(74) *Attorney, Agent, or Firm* — Modiano & Associati; Albert Josif; Daniel O'Byrne

(57) ABSTRACT

A gym machine comprising a ground resting base, a structure for supporting a user which is associated with the resting base so that it can rotate about a rotation axis, at least one maneuvering body which is associated movably with the supporting structure and flexible elements which are stretched between the maneuvering body and the ground resting base, the supporting structure rotating about the rotation axis between a first configuration and a second configuration when a user supported by the structure moves the maneuvering body, applying to the maneuvering body an action which is opposite with respect to the action applied thereto by the flexible elements.

32 Claims, 9 Drawing Sheets

GYM MACHINE

The present invention relates to a gym machine.

BACKGROUND OF THE INVENTION

Gym machines or implements are known which allow the movement of the user in space while performing an exercise.

For example, the rowing machine allows, by using a slide, the horizontal translational motion of the user during exercise of the dorsal muscles.

Machines are also known which allow to facilitate the vertical traction exercise by using a lightening platform on which the user stands. In this case, the user is moved only in a vertical direction.

SUMMARY OF THE INVENTION

The aim of the present invention is to provide an improved gym machine that allows to exercise several muscle regions and simultaneously modifies the position of the body of a user in space so as to facilitate blood circulation and the keeping of a correct posture.

Within this aim, an object of the present invention is to achieve such aim with a structure which is simple, relatively easy to provide in practice, safe in use, effective in operation, and relatively low in cost.

This aim and these objects are achieved by the present gym machine, characterized in that it comprises a ground resting base, a structure for supporting a user which is associated with the resting base so that it can rotate about a rotation axis, at least one maneuvering or actuation body which is associated movably with the supporting structure and flexible elements which are stretched between the maneuvering body and the ground resting base, said supporting structure rotating about the rotation axis between a first configuration and a second configuration when a user supported by said structure moves the maneuvering body, applying thereto an action which is opposite with respect to the action applied by the flexible elements.

BRIEF DESCRIPTION OF DRAWINGS

Further characteristics and advantages of the present invention will become better apparent from the detailed description of some preferred but not exclusive embodiments of a gym machine according to the invention, illustrated by way of non-limiting example in the accompanying drawings, wherein.

DESCRIPTION OF THE PREFERRED EMBODIMENTS

Figure 1:
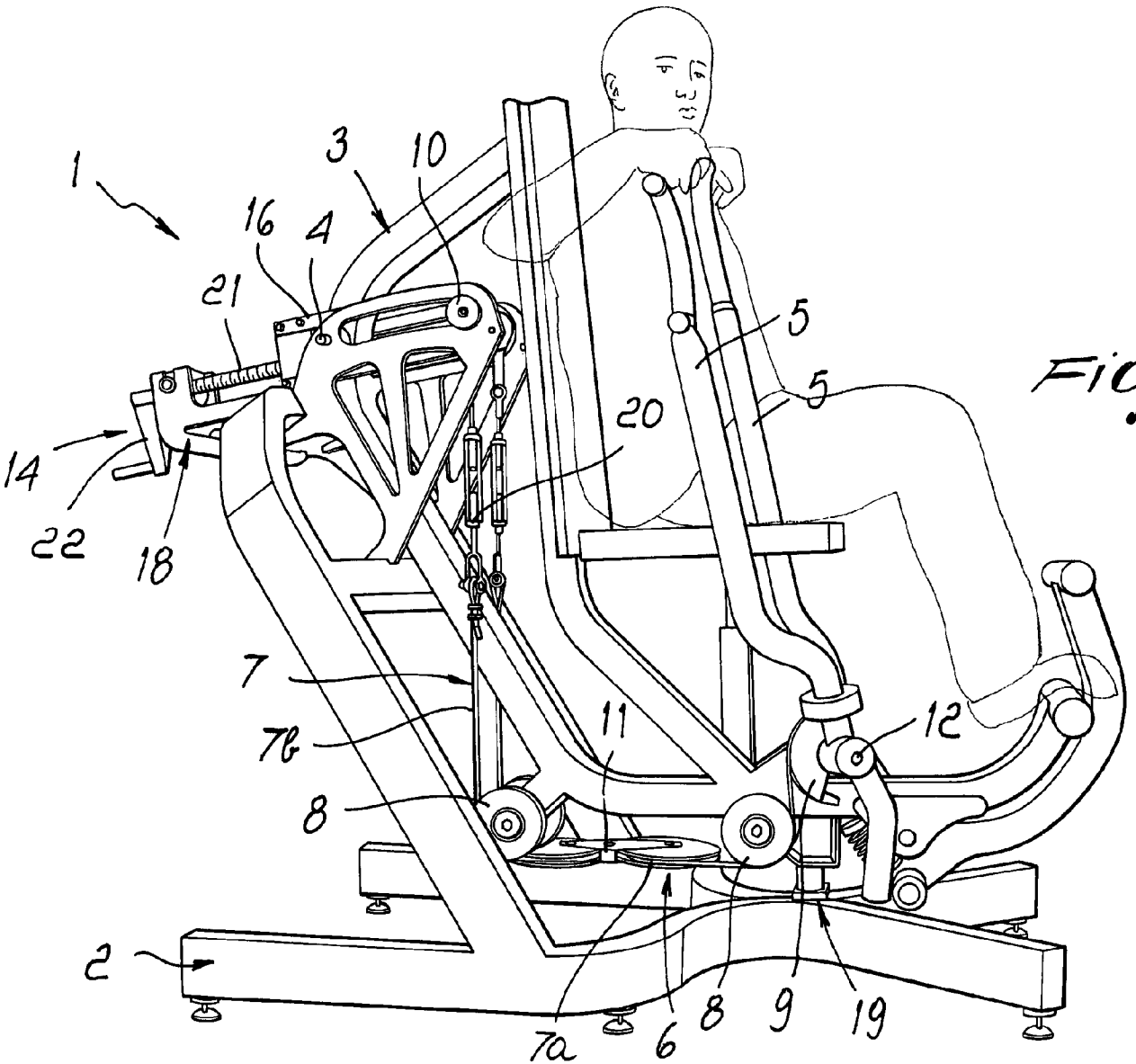
FIG. 1 is a schematic perspective view of a gym machine for exercising the upper limbs in a first balanced configuration.

With particular reference to the figures, the reference numeral 1 generally designates a gym machine.

The machine 1 comprises a ground resting base 2, which constitutes a fixed part of such machine.

A structure 3 for supporting a user is associated with the base 2 so that it can rotate about a rotation axis which is substantially parallel to the ground and is formed by a first pivot 4.

One or more maneuvering or actuation bodies 5 are associated with the supporting structure 3 so that they can move with respect to it by rotating or sliding. The maneuvering bodies 5 rotate together with the supporting structure 3 with respect to the first pivot 4.

The maneuvering bodies 5 and the base 2 are connected to each other by flexible elements 6, which are stretched between them. The flexible elements 6 retain both the maneuvering bodies 5 and the supporting structure 3, with which they are associated in their relative motion, in a first balanced configuration.

As will become better apparent hereinafter, the supporting structure 3 rotates about the first pivot 4 between a first balanced configuration and a second balanced configuration when a user supported by the supporting structure in a sitting, face-down or face-up position, moves the maneuvering body or bodies 5, applying thereto an action which is the opposite of the one applied thereto by the flexible elements 6.

The supporting structure 3 has a different shape, like a seat, bed, bench, table, platform or others, depending on the type of exercise for which the machine 1 is designed and as a function of which the user must assume a sitting, upright, face-down or face-up position.

The flexible elements 6 are constituted by cable means 7, which are wound around pulleys 8, which in turn are supported rotatably by the supporting structure 3 and/or by the maneuvering bodies 5. The cable means 7 have an end which is coupled to the maneuvering bodies 5 in a coupling point 9 and the opposite end which is coupled to the resting base 2 in a respective coupling point 10.

Figure 2:
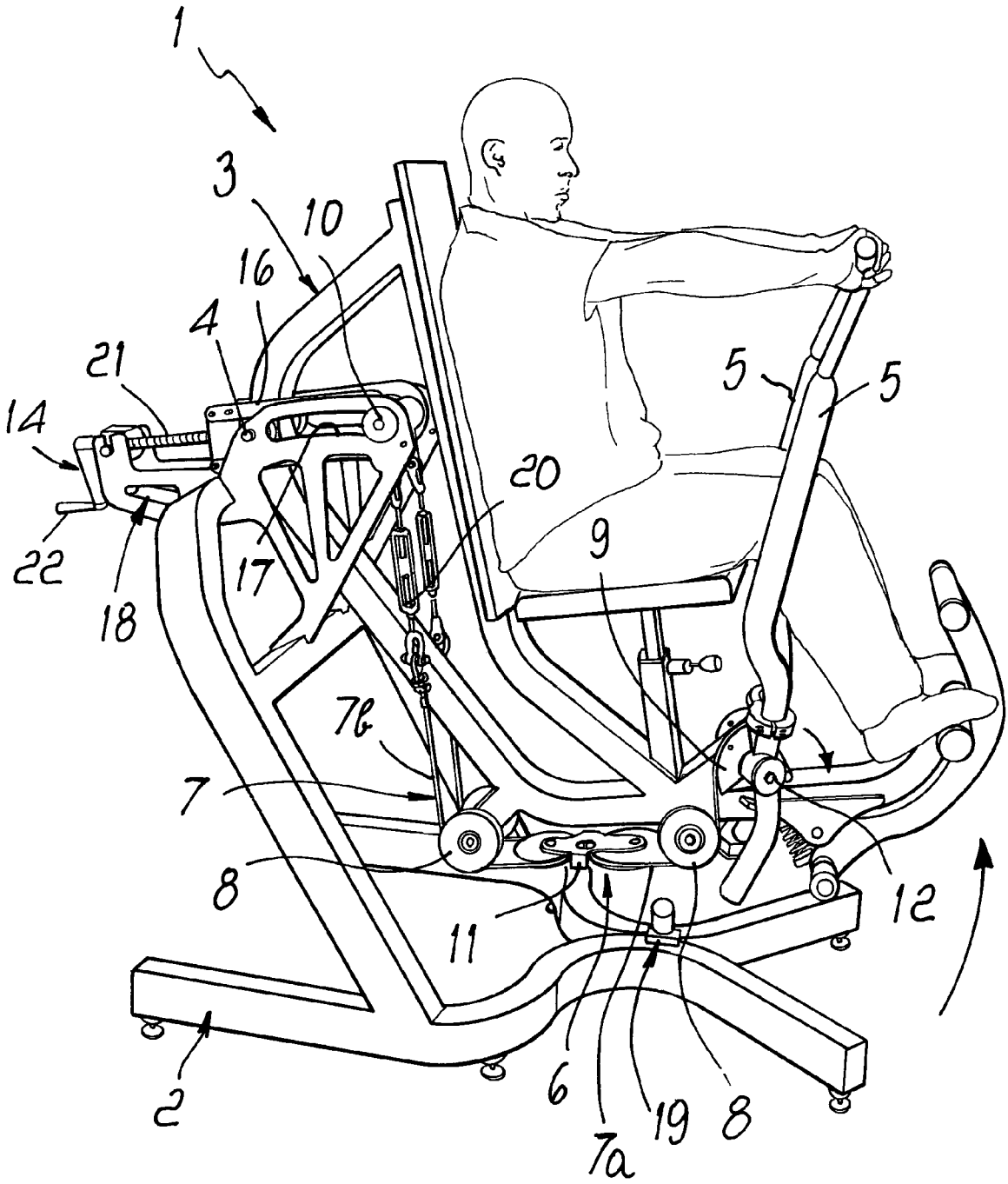
FIG. 2 is a schematic perspective view of the machine of FIG. 1 in a second balanced configuration.
Figure 3:
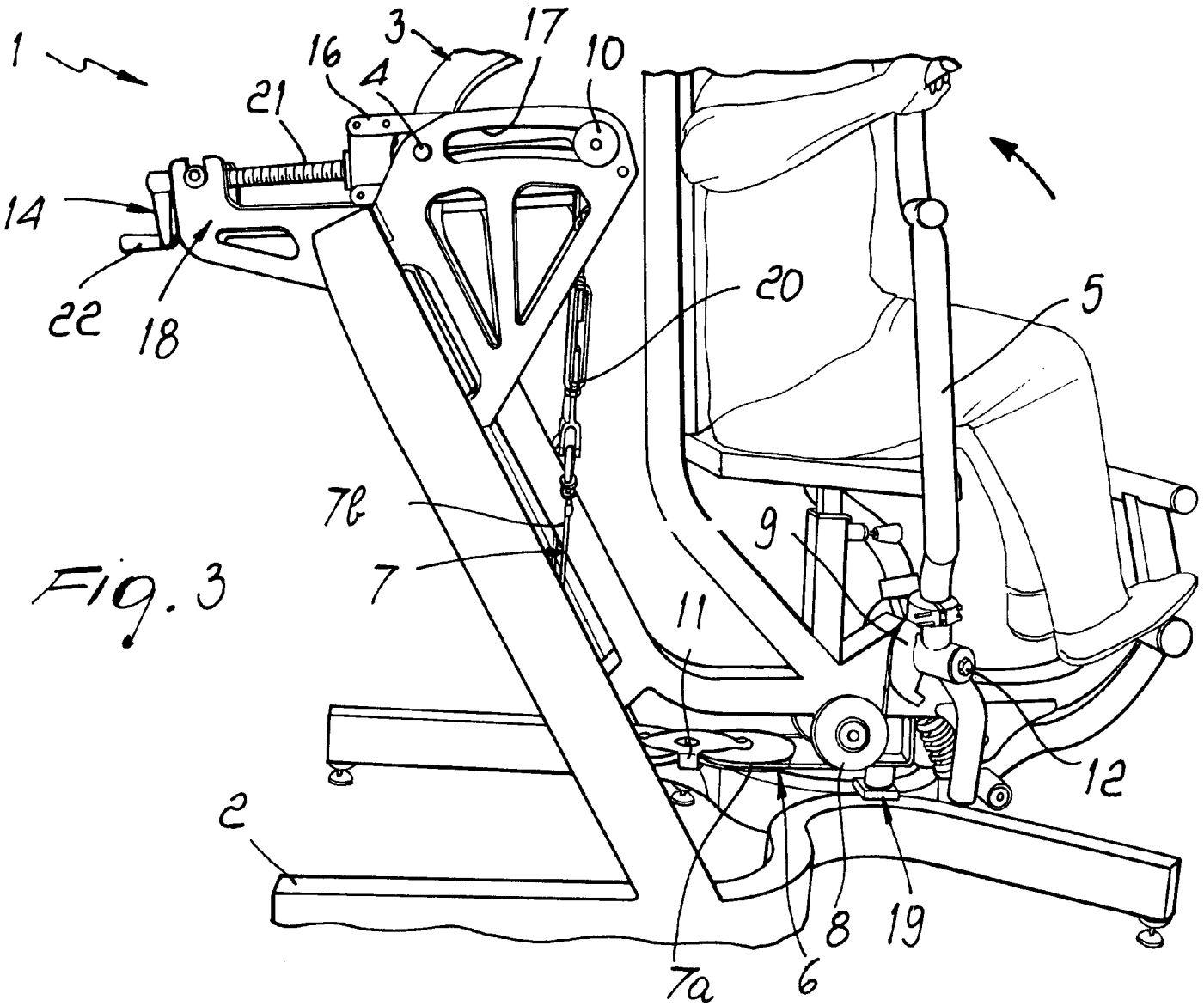
FIG. 3 is a schematic view of a portion of the machine of FIG. 1.
Figure 4:
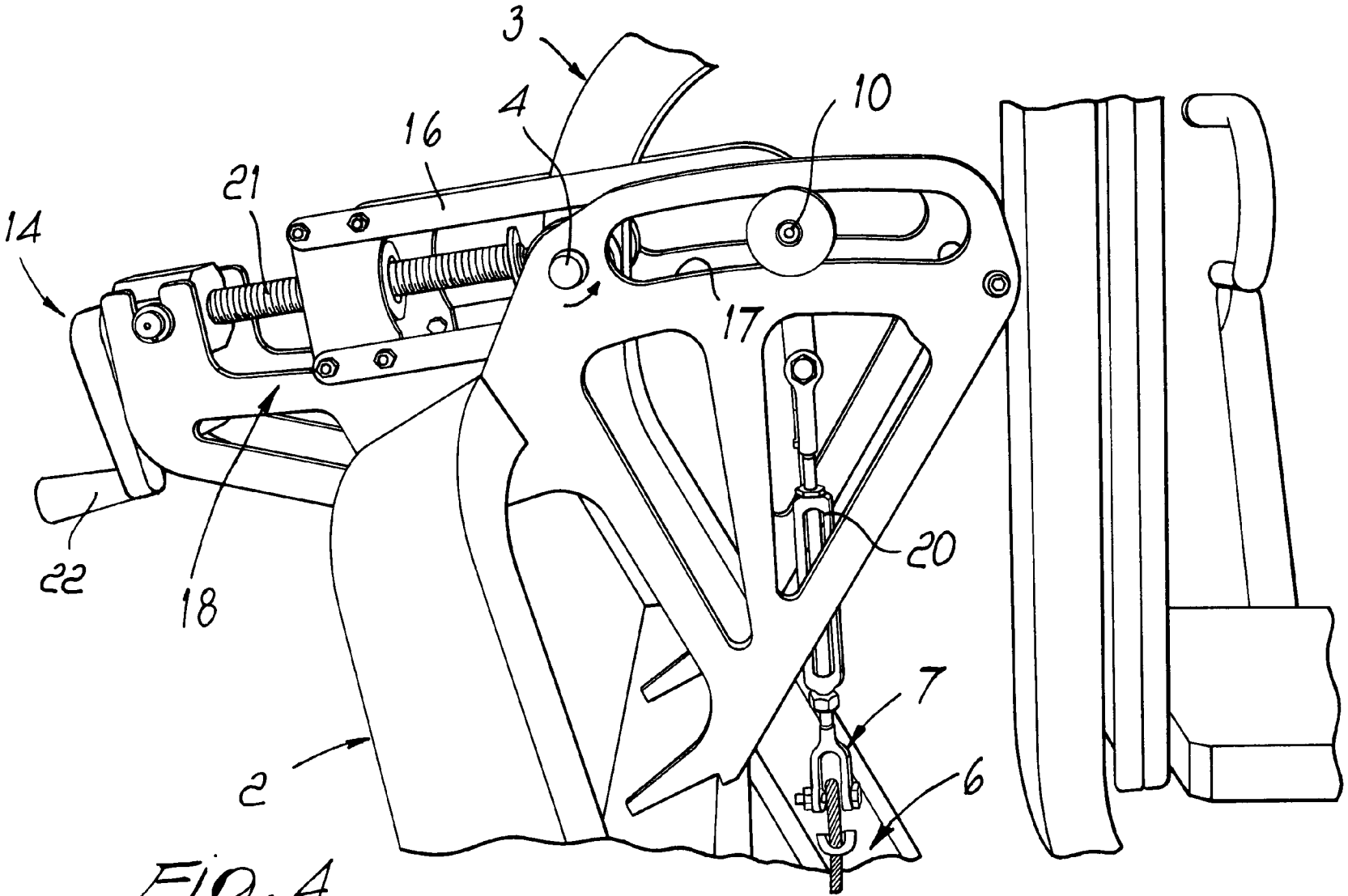
FIG. 4 is an enlarged-scale view of a detail of the machine of FIG. 1.

The cable means 7 are constituted by one or more cables which are connected one another, as shown in FIGS. 1 and 2, also as a function of the number of maneuvering bodies 5. Such bodies in fact can be constituted for example by two levers which are connected to the opposite ends of a first cable 7*a*, which in turn is rigidly coupled, by means of a guiding element 11, to a second cable 7*b* for connection to the resting base 2.

Depending on the exercises for which the machine 1 is designed, the maneuvering bodies 5 vary in terms of number, shape, arrangement and type of movable coupling to the supporting structure 3.

The maneuvering bodies 5 are constituted by one or more levers, as shown in FIGS. 1-8, which are associated so that they can rotate about a pivoting axis which is formed by a respective second pivot 12 and are maneuvered by means of the upper or lower limbs or the trunk of the user.

As an alternative, the maneuvering bodies 5 are constituted by a slide 13, which is associated with the supporting structure 3 so that it can slide along a system of straight guides which extend along a direction which is perpendicular to the first pivot 4.

The machine 1 further comprises means 14 for adjusting the coupling point 9 and/or 10 for the coupling of the flexible elements 6 respectively to the resting base 2, which is fixed to the ground, and to the maneuvering bodies 5.

The adjustment means 14 modify the position of the coupling points 9 and 10 of the opposite ends of the cable means 7 and therefore modify the load.

Figure 5:
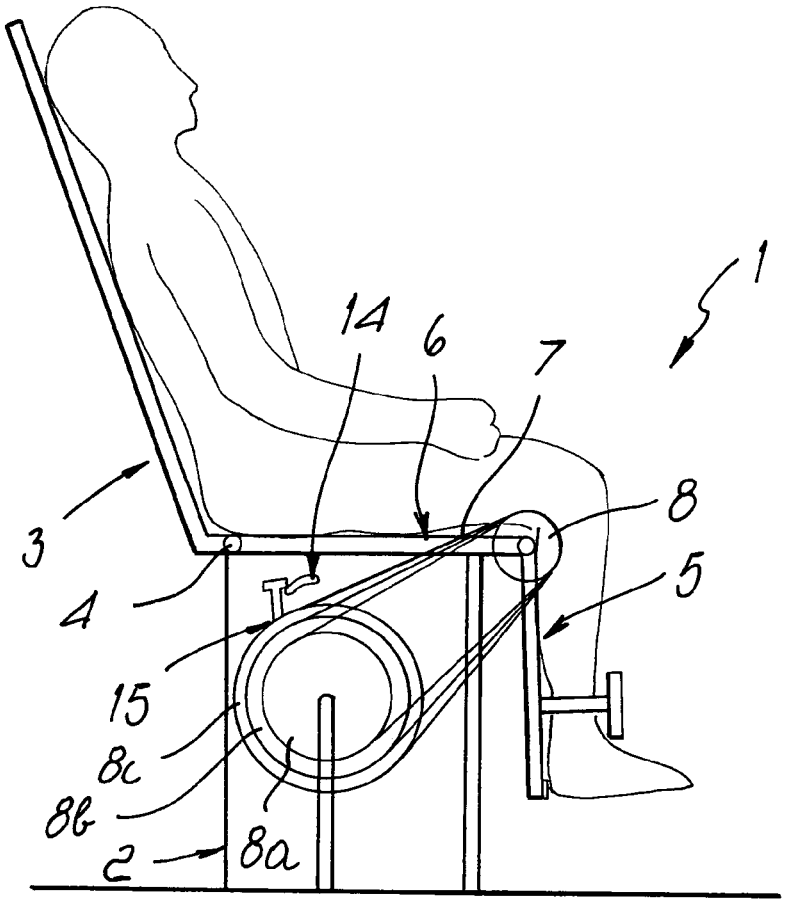
FIGS. 5 to 9 are schematic views of alternative embodiments of a machine according to the invention for exercising the lower limbs, respectively the quadriceps, the flexor muscles and the anteroposterior muscles.
Figure 8:
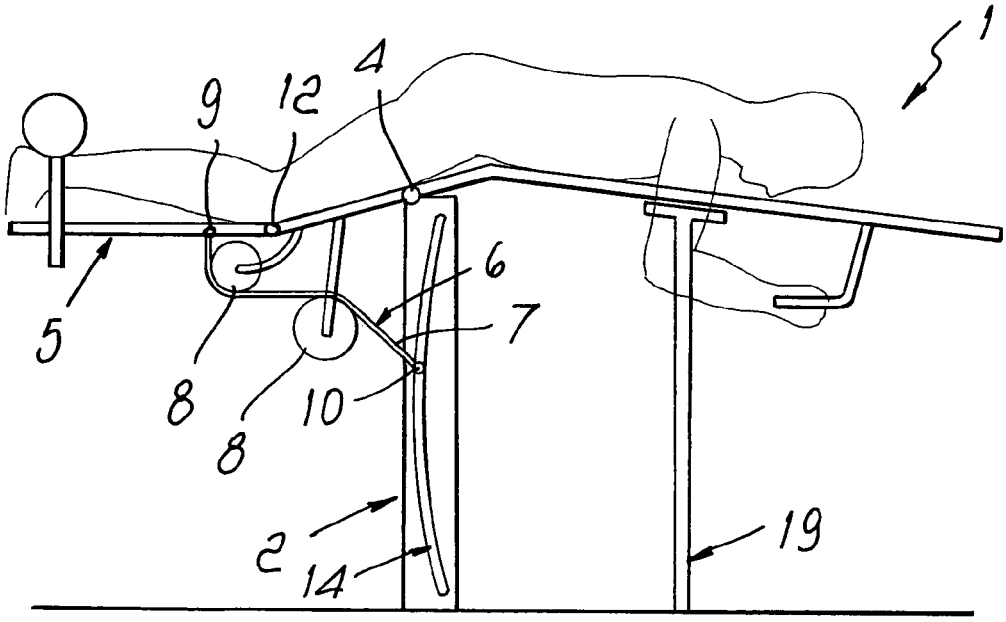
Figures 6, 7:
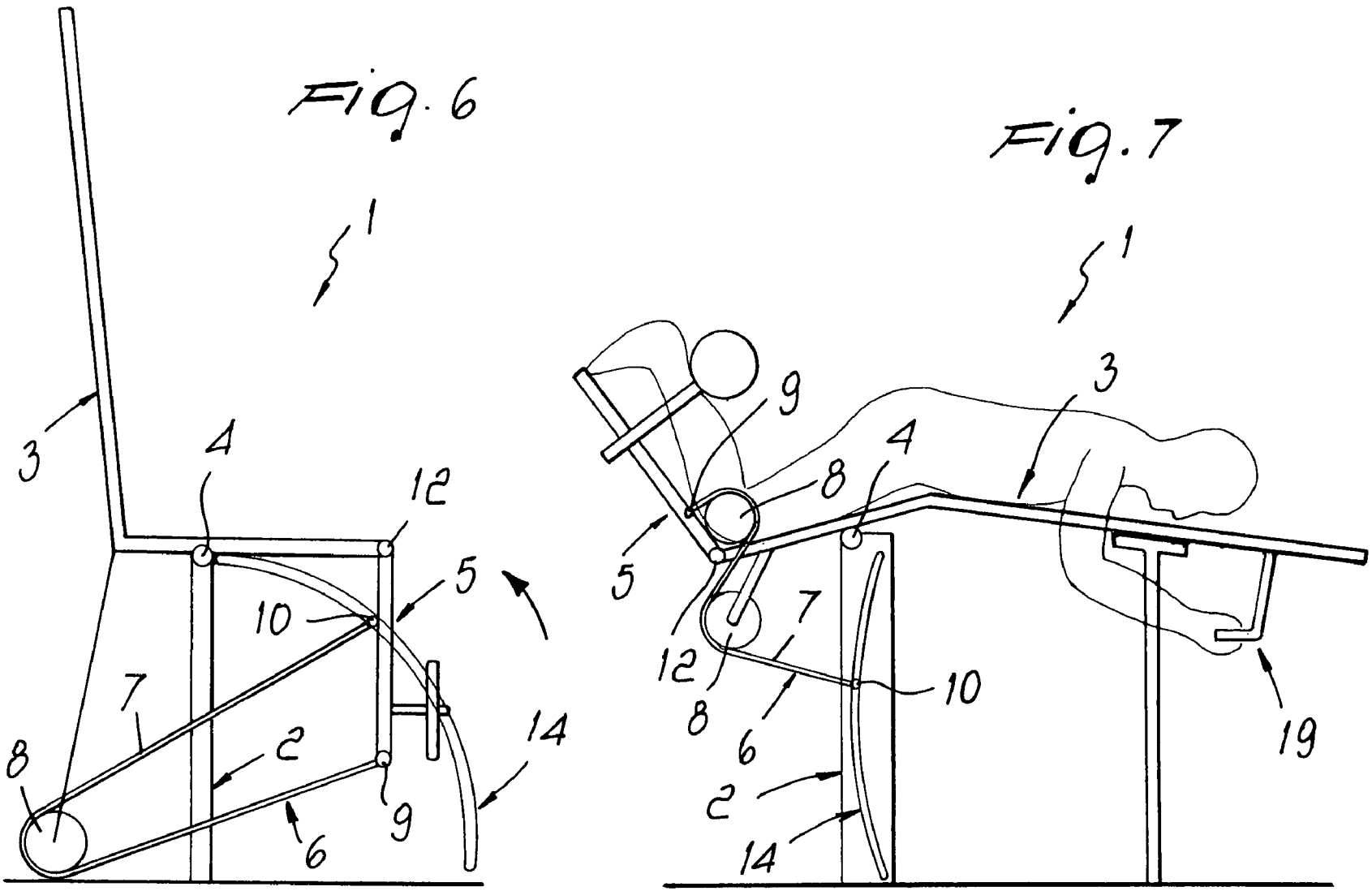

In a preferred embodiment, shown schematically in FIG. 5, there is a shift device 15, which is associated with at least one of the pulleys 8 and comprises two or more pulleys 8*a*, 8*b* and 8*c* having different diameters, which are engaged selectively by the cable means 7, elements for selecting the pulleys 8*a*, 8*b*, 8*c* being provided which are not described in detail since they are easily understandable to the person skilled in the art.

In a further preferred embodiment, as shown in FIGS. 1-4 and illustrated schematically in FIGS. 6-9, the adjustment means 14 are associated with the resting base 2 and the position of the point 10 of the cable means 7 for coupling to the resting base 2 is modified by way of such means.

The adjustment means 14 comprise a slider 16, on which the point 10 for coupling the cable means 7 to the resting base 2 is defined. The slider 16 is guided so that it can move along a path 17 which is formed in the resting base 2, means 18 being provided for maneuvering the slider 16, and therefore the coupling point 10, along the path 17.

The maneuvering means 18 are of a mechanical, electrical, electromechanical, hydraulic or pneumatic type.

The path 17 is arc-like; by acting on the maneuvering means 18, it is possible to move the slider 16 along the path 17 and thus modify the position of the point 10 for coupling the cable means 7 to the resting base 2. In particular, the coupling point 10 is moved toward or away from the rotation axis of the supporting structure 3, i.e., from the first pivot 4, thus varying the lever arm of the moment of the tension of the cable means 7 with respect to the first pivot 4 and therefore the force that the user must apply to the maneuvering bodies 5 in order to generate both the movement of such bodies and the consequent rotation of the supporting structure 3 with respect to the first pivot 4.

Moreover, means are provided for adjusting the position of the first pivot 4, not shown in detail, and devices for adjusting the extent of the tension of the cable means 7 such as tension elements 20.

The machine 1 further comprises means 19 for retaining the supporting structure 3 in its first balanced configuration.

The machine 1 shown in FIGS. 1-4 and intended to exercise the upper limbs is now described in greater detail.

The resting base 2 is cradle-shaped, the supporting structure 3 is seat-shaped and is articulated so that it can rotate about the first pivot 4, which is arranged at the rear upper end of the cradle.

Two maneuvering bodies 5 are pivoted proximate to the front end of the supporting structure 3 about respective second pivots 12 and are constituted by two levers which extend upwardly into a handle for the user.

The two maneuvering bodies 5 are connected to each other, at respective coupling points 9, to the opposite ends of the first cable 7*a* of the cable means 7, which by means of the guiding element 11 is rigidly coupled to the second cable 7*b* of the cable means 7. The opposite ends of the second cable 7*b* are coupled, with the interposition of tension elements 20, to the point 10 for coupling to the resting base 2.

The adjustment means 14 modify the position of the point 10 for coupling the cable means 7 to the resting base 2. Such adjustment means comprise the slider 16, to which the coupling point 10 is rigidly coupled. The position of the slider 16 is adjusted by the maneuvering means 18, which comprise a screw 21 which is supported so that it can rotate by the resting base 2 and is coupled to a female thread formed in the slider 16. The screw 21 is turned by actuation elements which are of the manual type, such as a crank 22, or electrical, electromechanical, pneumatic or hydraulic elements.

By acting on the crank 22, the position of the slider 16 and therefore of the coupling point 10 along the path 17 is modified so as to adjust the tension of the cable means 7.

Figure 9:
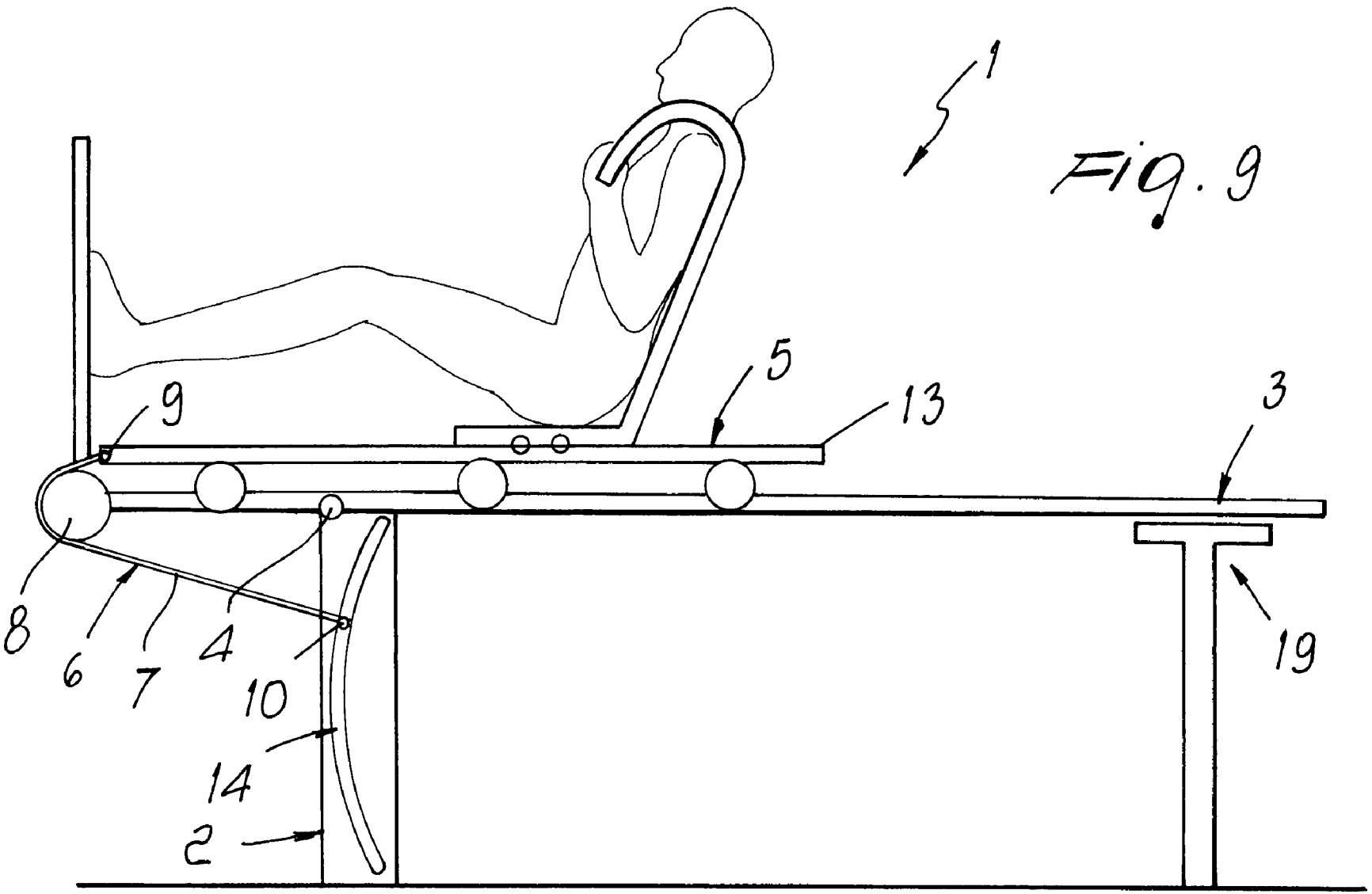
Figure 10:
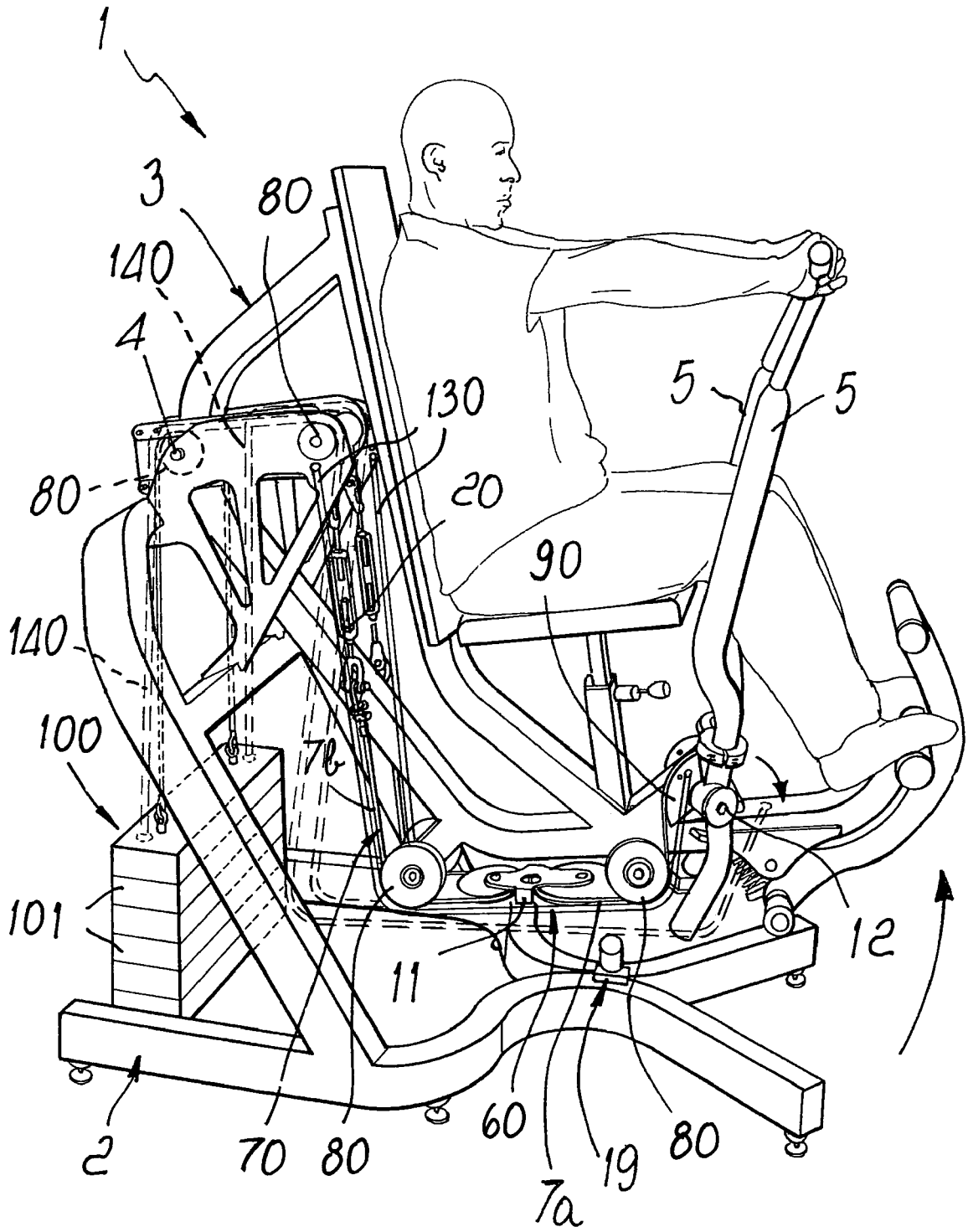
FIGS. 10 and 11 are schematic views of two alternative embodiments of the machine of FIG. 1 in the second balanced configuration.

FIGS. 9 and 10 illustrate respectively a possible alternative embodiment of the machine 1 as shown in FIGS. 1-4. In this case, the flexible elements 60 comprise cable means 70, 130, 140, which are wound around one or more pulleys 80 which are associated with the supporting structure 3 and with the resting base 2. The cable means 70, 130, 140 are double (for each maneuvering body 5), and one of them 130 has an end which is associated, in a respective coupling point 90, with the respective maneuvering body 5 and the opposite end which is associated with the base 2 in a fixed point (the machine is such that it rotates about its own center of gravity without producing load) and the other one 70, 140 has an end which is associated with the maneuvering body 5 (in the case of the cable means 70) or with the movable part (in the case of the cable means 140) of the machine and the opposite end which is associated with at least one device for generating a contrasting load 100.

In practice, the machine provides either for the simultaneous presence of the cable means 70 and 130 or for the simultaneous presence of the cable means 130 and 140, in any case a pair of cable means for each side of the machine.

Figure 11:
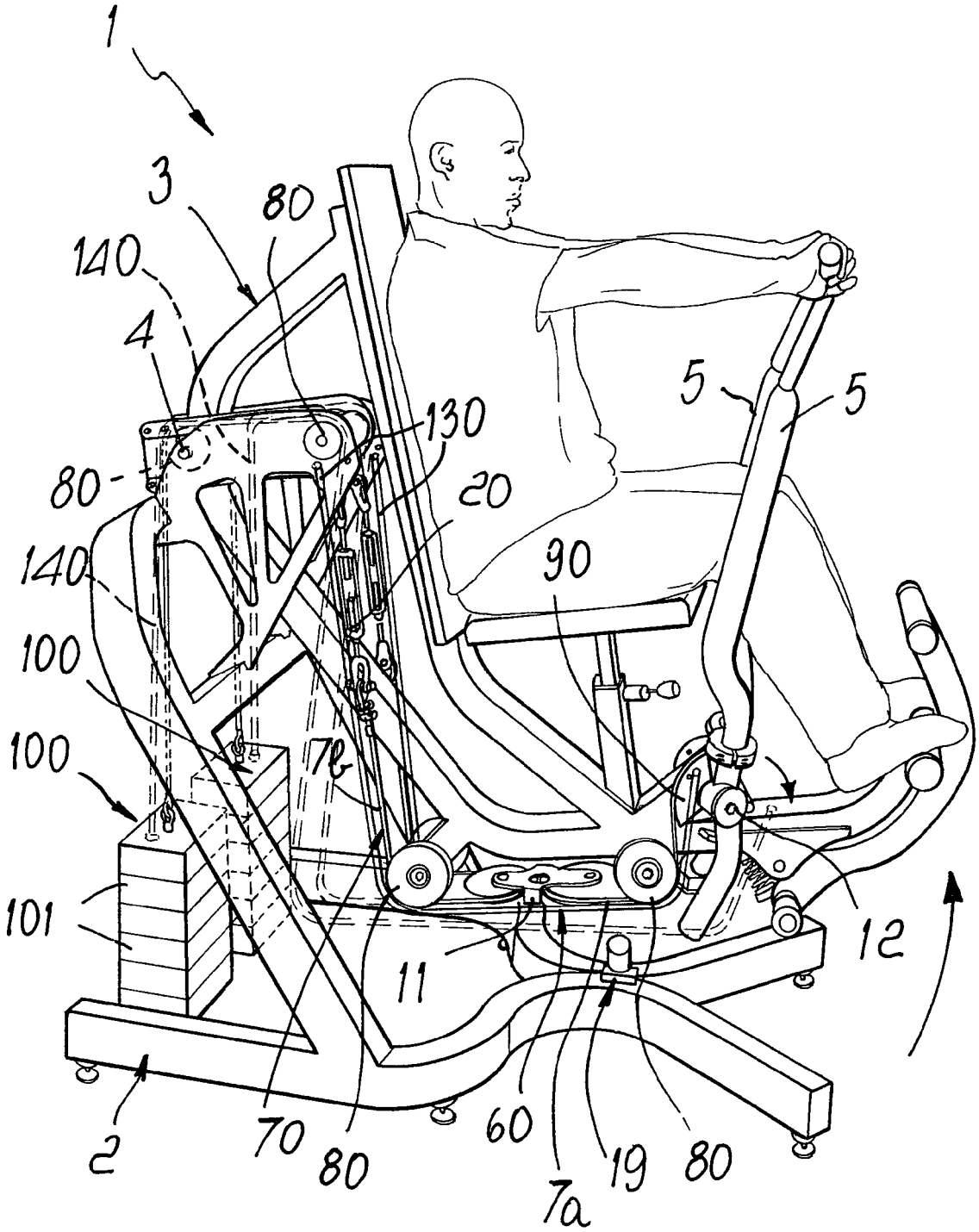

In the embodiment shown in FIG. 10, the device for generating a contrasting load 100 is shared by the cable means 70 associated with the two maneuvering bodies 5, while in the embodiment shown in FIG. 11 there is a device for generating a contrasting load 100 which is associated with a respective cable means 70, which in turn is associated with a respective maneuvering body 5.

The device for generating a contrasting load 100 is of the adjustable type, i.e., such that it is possible to vary the extent of the contrasting load generated thereby on the cable means 70.

In a preferred embodiment, the device for generating a contrasting load 100 is constituted by a counterweight, which in turn comprises one or more modular weights 101; by varying the number of modular weights 101 and/or the weight of each of such weights it is possible to modify the contrasting load applied to the cable means 70.

With reference to FIGS. 1 and 2, operation of the machine 1 is now described.

The machine 1 assumes a first balanced configuration (FIG. 1), in which the supporting structure 3 rests on the retention means 19 and the flexible elements 6 are tensioned between the maneuvering bodies 5 and the resting base 2.

A user sits on the seat of the supporting structure 3 and grips with his hands the handles of the maneuvering bodies 5.

The user pushes the maneuvering bodies 5 away from himself, applying to them an action which is opposite to the action of the flexible elements 6.

In this manner, not only the maneuvering bodies 5 rotate about the respective second pivots 12, but the entire supporting structure 3 of the user rotates, as indicated by the arrow, with respect to the first pivot 4, assuming a second balanced configuration.

In this manner, during physical exercise, the inclination of the user varies, with beneficial advantages for blood circulation.

By releasing the maneuvering bodies 5, the supporting structure 3 performs a rotation which is identical and opposite, returning to the first balanced configuration.

The person skilled in the art, without making any effort, understands that the same inventive concept is applied identically to machines designed to exercise other muscle regions, of which FIGS. 5-9 illustrate schematically and merely by way of non-limiting example some possible structures.

The supporting structure 3 can be shaped like a seat, bench, bed, table or platform to allow the support of a user who sits, stands upright, lies face down or face up.

The maneuvering bodies 5 can be constituted by one or more levers, which may even be independent from each other, or by sliding slides or others.

The flexible elements 6 can be provided by way of means which are mutually technically equivalent and easily understandable to the person skilled in the art; in particular, the number and arrangement of the cables of the cable means 7, the number, dimensions and position of the pulleys 8, and the provision and position of the coupling points 9 and 10 may vary.

The adjustment means 14 can be provided in order to modify the position of the point 10 for coupling the flexible elements 6 to the resting base 2 and to modify the position of the point 9 for coupling the flexible elements 6 to the maneuvering bodies 5.

It is further possible to provide adjustments of the position of the first rotation pivot 4 of the supporting structure 3 and adjustments of the degree of tension of said flexible elements 6.

In practice it has been found that the described invention achieves the proposed aim and objects.

The invention thus conceived is susceptible of numerous modifications and variations, all of which are within the scope of the appended claims.

All the details may further be replaced with other technically equivalent ones.

In practice, the materials used, as well as the shapes and dimensions, may be any according to requirements without thereby abandoning the scope of protection of the appended claims.

The disclosures in Italian Patent Application no. MI2007A001317, from which this application claims priority, are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A gym machine, comprising a ground resting base, a structure for supporting a user which is associated with said resting base so that it can rotate about a rotation axis, at least one maneuvering body which is associated movably with said supporting structure and flexible elements which are stretched between said maneuvering body and said ground resting base, said supporting structure rotating about said rotation axis between a first configuration and a second configuration when a user supported by said structure moves said maneuvering body, applying to said maneuvering body an action which is opposite with respect to the action applied thereto by said flexible elements, the machine further comprising means for adjusting a coupling point of said flexible elements to at least one between said ground resting base and said maneuvering body, wherein said means for adjusting said coupling point are associated with said resting base and comprise a slider which defines said point for coupling said flexible elements to said resting base and is guided so that it can move along a path which is formed within said resting base and means for maneuvering said slider along said path, and wherein said maneuvering means comprise a screw which is supported so that it can rotate by said resting base and is coupled to a female thread which is formed in said slider, manual, electrical, electromechanical, pneumatic or hydraulic elements for actuating the rotation of said screw being provided,

2. The machine according to claim 1, wherein said rotation axis is substantially parallel to the ground.

3. The machine according to claim 1, wherein said at least one maneuvering body is associated with said supporting structure so that it can rotate about a pivoting axis which is substantially parallel to said rotation axis.

4. The machine according to claim 1, wherein said maneuvering body is associated with said supporting structure so that it can slide along a direction which is substantially perpendicular to said rotation axis.

5. The machine according to claim 1, wherein said flexible elements comprise cable means which are wound around one or more pulleys which are associated with said supporting structure and/or with said maneuvering body and have an end which is associated in a respective coupling point with said maneuvering body and an opposite end which is associated in a respective coupling point with said ground resting base.

6. The machine according to claim 5, comprising a shift device which is associated with at least one of said pulleys and comprises at least one pair of pulleys having a different diameter which are selectively engaged by said cable means.

7. The machine according to claim 1, wherein said maneuvering means are of a mechanical or electrical, or electromechanical, or hydraulic or pneumatic type.

8. The machine according to claim 1, wherein said path has an arc-like profile.

9. The machine according to claim 1, wherein said flexible elements are double for each maneuvering body and comprise cable means which are wound around one or more pulleys which are associated with said supporting structure and with the resting base and have an end of one of said flexible elements which is associated in a respective coupling point with said maneuvering body and an opposite end which is fixed to the base, another one of said flexible elements having an end which is associated with the maneuvering body and another end which is associated with at least one device for generating a contrasting load.

10. The machine according to claim 9, wherein for each one of said maneuvering bodies there are respective said cable means, each of which has an end which is associated in a coupling point with the respective maneuvering body and the opposite end which is associated with a respective device for generating a contrasting load.

11. The machine according to claim 9, wherein said device for generating a contrasting load is of the adjustable type.

12. The machine according to claim 9, wherein said device for generating a contrasting load comprises at least one counterweight.

13. The machine according to claim 1, wherein said rotation axis is formed by pivot or shaft, elements for adjusting a position of said pivot or said shaft with respect to said resting base and/or said supporting structure being provided.

14. The machine according to claim 1, comprising devices for adjusting a tension of said flexible elements.

15. The machine according to claim 14, wherein said tension adjustment devices comprise at least one tension element which is associated with said flexible elements.

16. A gym machine, comprising a ground resting base, a structure for supporting a user which is associated with said resting base so that it can rotate about a rotation axis, at least one maneuvering body which is associated movably with said supporting structure and flexible elements which are stretched between said maneuvering body and said ground resting base, said supporting structure rotating about said rotation axis between a first configuration and a second configuration when a user supported by said structure moves said maneuvering body, applying to said maneuvering body an action which is opposite with respect to the action applied thereto by said flexible elements, wherein said flexible elements are double for each maneuvering body and comprise cable means which are wound around one or more pulleys which are associated with said supporting structure and with the resting base and have an end of one of said flexible elements which is associated in a respective coupling point with said maneuvering body and an opposite end which is fixed to the base another one of said flexible elements having an end which is associated with the maneuvering body and another end which is associated with at least one device for generating a contrasting load.

17. The machine according to claim 16, wherein said rotation axis is substantially parallel to the ground.

18. The machine according to claim 16, comprising means for adjusting a coupling point of said flexible elements to at least one between said ground resting base and said maneuvering body.

19. The, machine according to, claim 16, wherein said at least one maneuvering body is associated with said supporting structure so that it can rotate about a pivoting axis which is substantially parallel to said rotation axis.

20. The machine according to claim 16, wherein said maneuvering body is associated with said supporting structure so that it can slide along a direction which is substantially perpendicular to said rotation axis.

21. The machine according to claim 16, wherein said flexible elements comprise cable means which are wound around one or more pulleys which are associated with said supporting structure and/or with said maneuvering body and have an end which is associated in a respective coupling point with said maneuvering body and an opposite end which is associated in a respective coupling point with said ground resting base.

22. The machine according to claim 21, comprising a shift device which is associated with at least one of said pulleys and comprises at least one pair of pulleys having a different diameter which are selectively engaged by said cable means.

23. The machine according to claim 18, wherein said means for adjusting said coupling point are associated with said resting base and comprise a slider which defines said point for coupling said flexible elements to said resting base and is guided so that it can move along a path which is formed within said resting base and means for maneuvering said slider along said path.

24. The machine according to claim 23, wherein said maneuvering means are of a mechanical or electrical, or electromechanical, or hydraulic or pneumatic type.

25. The machine according to claim 24, wherein said maneuvering means comprise a screw which is supported so that it can rotate by said resting base and is coupled to a female thread which is formed in said slider, manual, electrical, electromechanical, pneumatic or hydraulic elements for actuating the rotation of said screw being provided.

26. The machine according to claim 23, wherein said path has an arc-like profile.

27. The machine according to claim 16, wherein for each one of said maneuvering bodies there are respective said cable means, each of which has an end which is associated in a coupling point with the respective maneuvering body and the opposite end which is associated with a respective device for generating a contrasting load.

28. The machine according to claim 16, wherein said device for generating a contrasting load is of the adjustable type.

29. The machine according to claim 16, wherein said device for generating a contrasting load comprises at least one counterweight.

30. The machine according to claim 16, wherein said rotation axis is formed by a pivot or shaft, elements for adjusting a position of said pivot or said shaft with respect to said resting base and/or said supporting structure being provided.

31. The machine according to claim 16, comprising devices for adjusting a tension of said flexible elements.

32. The machine according to claim 31, wherein said tension adjustment devices comprise at least one tension element which is associated with said flexible elements.

* * * * *